US005234721A

United States Patent [19]

Rostoker et al.

[11] Patent Number: 5,234,721

[45] Date of Patent: Aug. 10, 1993

[54] METHOD FOR FORMING CARBIDE COATING ON VARIOUS METALS AND THEIR ALLOYS

[75] Inventors: William Rostoker, Homewood, Ill.; Julius J. Bonini, Munster, Ind.; Gary W. Klimczak, Lemont, Ill.

[73] Assignee: Rostoker, Inc., Burnham, Ill.

[21] Appl. No.: 358,549

[22] Filed: May 26, 1989

[51] Int. Cl.[5] ..... C23C 2/00

[52] U.S. Cl. ..... 427/431; 427/432; 427/435; 427/248.1; 148/242; 148/278

[58] Field of Search ..... 427/431, 435, 248.1, 427/432; 148/242, 278

[56] References Cited

U.S. PATENT DOCUMENTS

| | | | |
|---|---|---|---|
| 2,784,639 | 3/1957 | Keenan | 427/248.1 |
| 2,892,743 | 6/1959 | Griest et al. . | |
| 3,719,518 | 3/1973 | Komatsu | 427/431 |
| 3,885,059 | 5/1975 | Komatsu | 427/431 |
| 3,922,405 | 11/1975 | Komatsu | 427/431 |
| 3,930,060 | 12/1975 | Komatsu | 427/431 |
| 4,151,325 | 4/1979 | Welch | 427/248.1 |
| 4,158,578 | 6/1979 | Komatsu | 148/242 |
| 4,202,705 | 5/1980 | Komatsu | 148/242 |
| 4,722,852 | 2/1988 | Hoeberechts | 427/248.1 |
| 4,832,986 | 5/1989 | Gladfelter | 427/248.1 |

FOREIGN PATENT DOCUMENTS

| | | | |
|---|---|---|---|
| 290492 | 9/1965 | Australia | 148/242 |
| 1312819 | 11/1962 | France . | |
| 1388934 | 1/1965 | France . | |

OTHER PUBLICATIONS

Webster's Seventh New Collegiate Dictionary G & C Merriam Company, 1963, p. 289.

Coating of High Temperature Materials, ch. 2, H. H. Hausner, ed., Plenum Press, New York, 1966.

Interim Report on Static Liquid-Metal Corrosion, A. deS. Brasunas, Oakridge National Laboratory pp. 1–44, Jun. 1, 1954.

*Primary Examiner*—Shrive Beck
*Assistant Examiner*—Vi Duong Dang
*Attorney, Agent, or Firm*—Rockey, Rifkin and Ryther

[57] ABSTRACT

A method for forming a carbide coating of Group IVA, VA and VIA transition metals and their alloys. The metal to be coated is heated in a bath of molten alkali or alkaline earth metal containing carbon. There is also provided a method for preparing a metal surface for carburization by heating the metal in a nitrogen-containing atmosphere.

2 Claims, 3 Drawing Sheets

CARBIDE COATING ON PRETREATED TANTALUM
MAGNIFICATION: X 375

COATING THICKNESS ON Ti(6,4) AS A FUNCTION OF TEMPERATURE AND CONTACT TIME PARAMETER

CARBIDE COATING ON Ti(6,4)
MAGNIFICATION: X 375

CARBIDE COATING ON PRETREATED TANTALUM
MAGNIFICATION: X 375

CARBIDE COATING ON UNTREATED TANTALUM
MAGNIFICATION: X 375

METHOD FOR FORMING CARBIDE COATING ON VARIOUS METALS AND THEIR ALLOYS

FIELD OF THE INVENTION

This invention relates to a method of providing a wear-resistant coating on various metals and their alloys and, more particularly, to an improved method for forming metal carbide coatings on such metals and alloys.

BACKGROUND OF THE INVENTION

Various members of the IVA, VA and VIA transition elements in the periodic table have properties which make them very useful in practical applications. Titanium, for example, has excellent corrosion resistance. Furthermore, its alloys have a high strength to weight ratio which makes them useful in applications where weight is important, such as in aircraft construction. In addition, titanium has been used extensively to construct biomedical implants because of its substantial non-toxicity to humans and animals.

Although titanium and its alloys have many excellent properties, this metal has a tendency to gall to mating surfaces of itself and almost any material. This weakness is exhibited in several situations. Titanium fasteners tend to seize in the threads during tightening so they cannot be driven to their full extent or, once so, cannot be loosened by backing off without destroying the fastener. In similar fashion, valve seats and valve spool threads are rendered inoperative. Despite effective lubrication, mechanical drive systems, such as gear trains made from high strength titanium alloys, exhibit abnormal rates of wear so that critical clearances cannot be maintained and freedom of motion in start and stop conditions is lost. Because of their excellent strength to weight ratios and ability to withstand high temperatures, titanium component parts would be used in shaft bearings of the roller, ball and sliding types operating at high temperatures if a means could be provided to overcome their tendency to gall.

Titanium alloys have been used in implantible human joint devices for the hip and knee. Such medical applications involve articulation of polished titanium surfaces against ultra high molecular weight polyethylene. In a few such applications, abnormal wear and consequent need for revision surgery have occurred. It appears that in such instances, the passive film that normally protects titanium from corrosion is somehow ruptured. It is believed that reformation of the passive film is prevented by galling of the titanium surface as it slides against the polyethylene under pressure.

In the various applications where titanium could be or is already widely used, a hard surface with improved anti-galling characteristics would be valuable. Since titanium carbide is one of the hardest metallic materials, a surface coating of this material could provide these properties. Various attempts to form carbides of metals are reported in *Coating of High-Temperature Materials*, ch. 2, H. H. Hausner, ed., Plenum Press, New York, 1966. Much of this work carried out in the Soviet Union involves gaseous deposition and vacuum deposition methods to carburize the metals. These methods were often carried out in the presence of hydrogen or hydrogen containing compounds as noted, for example, in U.S. Pat. No. 2,892,743. It is well-known that absorbed hydrogen has a detrimental effect on the mechanical properties of the metals. Furthermore, such methods do not coat the metal uniformly and are not cost effective where more than a few microns of carbide coating are required.

We have now discovered a method for forming a carbide coating of the metals of Group IVA, VA and VIA of the periodic table, which imparts wear resistance and galling resistance to the surface of the metals. Carbide coatings at depths in excess of about 5 microns resists the penetration of sharp, pointed objects of hardened steel. Furthermore, the coating process can be adapted to give a uniform and substantially continuous coating on all surfaces of the metal object being coating.

SUMMARY OF THE INVENTION

In accordance with this invention there is provided a method for forming a carbide coating on a metal substrate selected from the group consisting of Group IVA metals, Group VA metals, Group VIA metals and alloys of said metals, which comprises providing a bath of molten metal under an inert gas atmosphere wherein the molten metal is selected from the group consisting of alkali metals, alkaline earth metals and mixtures thereof; dissolving in the molten metal bath an amount of carbon effective to form the carbide coating; placing the metal substrate in the molten metal bath containing dissolved carbon; maintaining the metal substrate in the molten metal bath until a carbide coating is formed on the metal substrate; and removing the carbide coated metal substrate from the molten metal bath.

Further provided, in accordance with this invention, is a method for preparing the surface of a metal substrate for carburization which comprises heating the metal substrate in an atmosphere containing nitrogen for a sufficient time to form a visible nitride layer on the surface of the metal substrate.

Figure 1:
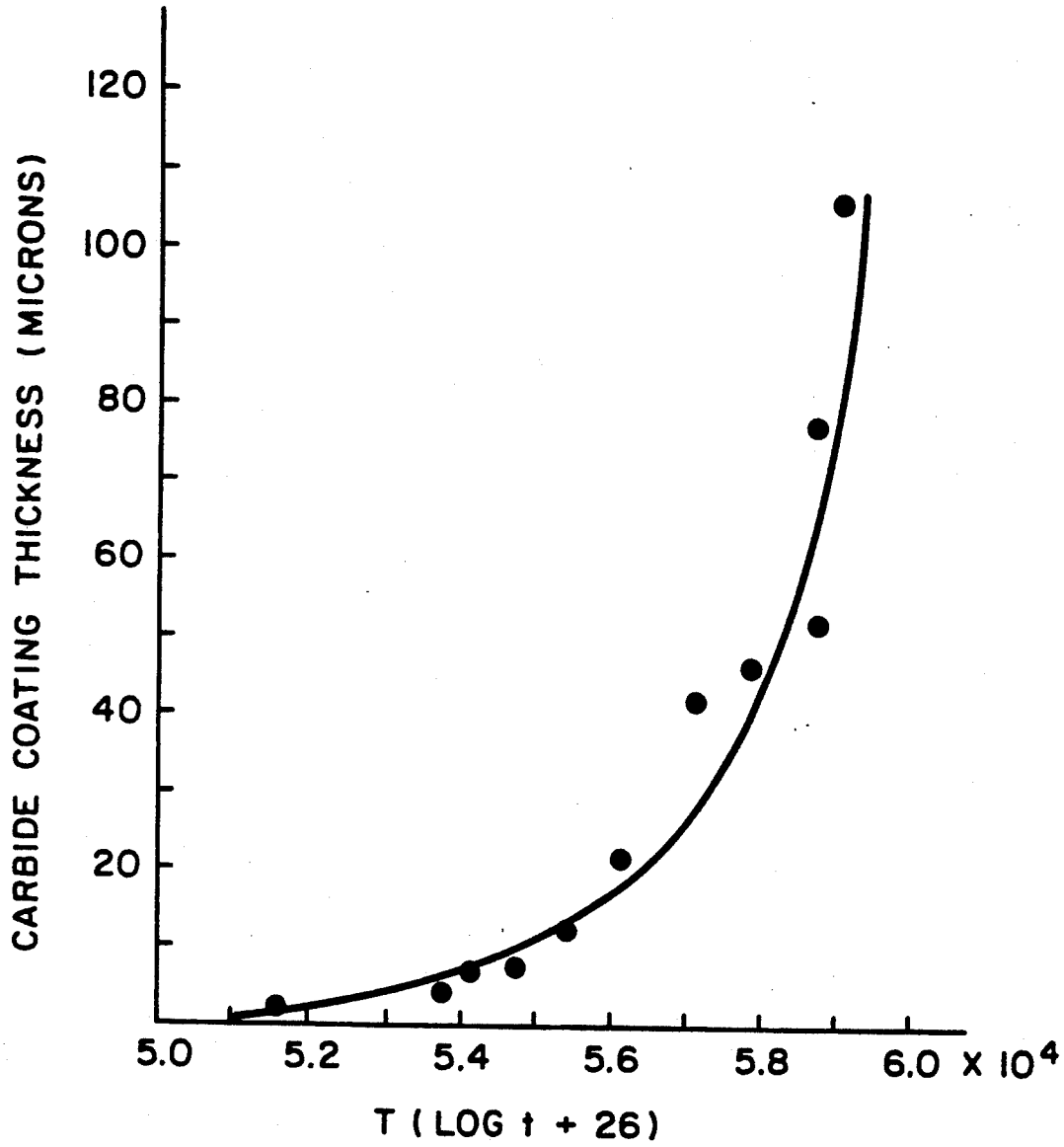
FIG. 1 is a graph which discloses the relationship of the thickness of the carbide coating which forms on a Ti(6,4) (a titanium alloy containing 6 percent Al and 4 percent V) substrate and the time and temperature of the carburizing reaction. A molten lithium bath containing twenty percent carbon was used to generate the data shown in FIG. 1.

The metal substrate specimens were prepared for photomicrography by the following process. Each specimen after carburizing was nickel-plated using an electroless nickel plating solution. The specimens were then sectioned in a direction transverse to the carburized surface, using a diamond saw and copious amounts of lubricant. The sectioned specimens were mounted, ground, polished and etched in accordance with standard metallographic practice. The use of the nickel deposit, on the carburized surface, is only for the purpose of enhancing the metallography of the specimens. The nickel plate, being extremely hard, protects the integrity of the refractory metal carbide during the polishing operations.

DETAILED DESCRIPTION OF THE INVENTION

The process of this invention is used to form carbide coatings on substrates which are either metals or their alloys. As noted above, the metals used as substrates are from the Group IVA, VA and VIA transition elements in the periodic table. The process of this invention has been demonstrated by the formation of carbide coatings on titanium, vanadium, niobium, tantalum and molybdenum. Although a carbide coating was not formed on a tungsten substrate at temperatures up to 1100° C., it is believed that the process would be applicable to this substrate as well if one employed equipment suitable for use at higher temperatures.

The process of this invention is particularly suitable for forming carbide coatings on titanium and its alloys. The titanium alloy, Ti(6,4), is widely used in commercial applications because of its excellent combination of toughness and various kinds of strengths. For this reason, a number of examples are given using this titanium alloy as the substrate. In this connection, it is noted that the term "metal substrate" as used herein, includes both the metal and its alloys.

The process of this invention is carried out by placing a metal substrate in a molten metal bath containing dissolved carbon. The substrate is maintained in the bath preferably at a temperature above about 700° C., until a carbide coating is formed on the substrate. The reaction is carried out under an atmosphere of an inert gas. By inert gas is meant one that does not react with either the metal substrate or the metals of the molten metal bath. A particularly suitable inert gas for this purpose is argon, preferably an argon of greater than 99.9 percent purity.

The metals used for forming the molten metal bath employed in the process of this invention are alkali and alkaline earth metals having purities of ninety-nine percent or better. Suitable metals include lithium, calcium, barium, strontium, sodium and mixtures thereof. Lithium is a particularly useful metal because of its ability to dissolve appreciable amounts of carbon at the temperatures employed in the process.

In carrying out the process of this invention, carbon is dissolved in the molten metal. The carbon is preferably finely divided so that it will dissolve readily. Various carbon sources may be used provided that they do not contain impurities which interfere with the carburizing reaction. For example, a graphite of high purity may be used. A preferred carbon source is carbon black in very fine, particulate form having a purity better than 99.9 percent. The amount of carbon employed may vary widely as long as there is sufficient carbon to form a layer of carbide of desired thickness on the metal substrate. A suitable range of carbon is from about two percent to about twenty percent by weight of the mixture of molten metal and carbon.

As noted above, the process of this invention is preferably carried out at a temperature above about 700° C. For most substrates, the temperature of the molten metal bath is maintained from about 800° C. to about 1100° C. during the formation of the carbide coating. However, this temperature may vary depending upon the particular metal substrate to be coated. For example, when the titanium alloy Ti(6,4) is coated, the carburizing reaction is carried out at a temperature from about 800° C. to about 950° C. because the mechanical properties of this alloy are degraded at temperatures above the beta phase transus, which is about 980° C.

To complete the process of this invention, the metal substrate is maintained in the molten metal bath containing carbon for a time sufficient to form a carbide coating on the metal substrate of the desired thickness. It has been found that the time and temperature can be combined into a single parameter that is continuous function of the coating thickness. This relationship is the same as that described for the time-temperature relationship in tempering steels, Holloman and Jaffe, *Trans Am Inst. Metallurgical Eng.*, 162, 223–249 (1945). This parameter (P) is defined by the equation:

$$P = T(\log t = C)$$

where T is the temperature in degrees Rankine, t is the time in hours and C is the absolute value of the intercept with the log t axis on a plot of log t versus 1/T. The magnitude of C for the carburizing process was determined to be 26 for Ti(6,4). FIG. 1 shows the experimental data for the thickness of the carbide coating plotted against P for this alloy. This graph is useful for predicting coating thickness for any combination of temperature and time. Similar graphs may be constructed for any of the metal substrates used in the process of this invention.

After the desired carbide coating is formed on the metal substrate, this substrate is removed from the molten metal bath and allowed to cool to ambient temperature. It is preferred that the cooling should be gradual, at a rate effective to prevent thermal shock, spalling and cracking of the carbide coating.

In order to prepare the surface of the metal substrate for the carburizing reaction, it is first treated to remove foreign films and surface deposits. One method for doing this is to pickle the specimen in an aqueous solution containing twenty percent nitric acid and two percent hydrofluoric acid. This treatment also serves to passivate the surface by thickening the naturally-formed oxide film of indeterminate identity which covers the surface.

A preferred method for treating the surface of the refractory metal substrate involves heating the substrate in an atmosphere containing nitrogen. Heating is continued until a visible nitride layer is observed on the metal surface. This process forms an exceedingly thin coating of nitride or oxy-nitride on the surface of the metal or metal alloy. Prolonged nitrogen treatment should be avoided, since it is well-known that absorption of excess nitrogen can weaken the metal. For this pretreatment, an exposure to nitrogen gas at about 500° C. for about two hours is sufficient. Air may be substituted for nitrogen in this process. It has been discovered that this pre-treatment provides more reproducible and uniform carbide coatings on the metal substrate.

Carbide coating formed by the process of this invention confers wear resistance and galling resistance to the substrate metal. Furthermore, when specimens with blind holes of different depths and diameters are carburized by this process, the depth of the carbide coating at the bottom and down the sides of the smallest and deepest holes is found to be almost exactly the same as on the planar surface of the specimen. In addition, the excellent properties of the coated materials are retained even after they are subjected to subsequent thermal treatments such as vacuum annealing.

The carbide surface formed on a Ti(6,4) substrate by the process of this invention was shown to contain TiC by an X-ray surface analysis technique known as electron spectroscopy for chemical analysis.

The following examples were carried out in a stainless steel retort. This was a vertical tubular enclosure whose internal space was isolated from the normal room environment. The internal space contained a regulated environment of a vacuum or an inert gas. The bottom half of the retort was sealed in an electrically heated pot furnace which was capable of controlling the internal temperature from about 700° C. to about 1200° C. The upper half of the retort was water-cooled by a means of a coil of copper tubing bonded to the outside of the retort. This cooling preserved the integrity of the lid/flange seals through which thermocouples, gas-ducts, and specimen manipulators were inserted and actuated. A metal shield was also inserted into the retort to a level above the hot zone to act as a reflector to reduce the heat impact on the water-cooled surfaces and to reduce the temperature gradients in the hot zone.

The metal-carbon bath was contained in a right cylindrical, titanium crucible having a wall thickness of about 7 mm. The space between the retort inner wall and the crucible was about 10 mm. The tip of a thermocouple was positioned in that space. The depth of the molten metal in the titanium crucible was about 100 mm.

Specimens to be carburized were attached to the bottom end of a titanium rod of about 12 mm diameter and length sufficient to reach to the bottom of the crucible and project to about 150 mm above the flanged lid seal of the retort. This push/pull rod moved through the flanged lid by means of a seal which permitted both sliding and rotation of the rod. By this means, specimens could be lowered into and raised from the molten metal bath. In some experiments the rod was rotated to provide a stirring action.

The carburizing process was carried out in the following manner. The alkali or alkaline earth metal to be used in the molten metal bath and the carbon black were placed in the titanium crucible. The specimen to be coated was attached to the bottom end of the titanium rod and the rod was raised sufficiently to maintain the specimen above the titanium crucible. The retort was sealed, positioned in the pot furnace and evacuated to a pressure less than 500 microns of Hg (0.5 Torr). It was then backfilled with argon, reevacuated and refilled with argon. As the temperature of the retort was raised to about 200° C., the retort was evacuated again, refilled with argon and maintained for the remainder of the experiment at slightly above atmospheric pressure.

Heating was continued until the metal in the titanium crucible had become molten and had reached the desired temperature. The specimen was then lowered into the molten metal which also contained dissolved carbon. The specimen was then maintained in the molten metal bath for the desired length of time.

The following examples illustrate the invention. It is to be understood that the examples are illustrative only and do not intend to limit the invention in any way. In the examples, all parts and percentages are by weight and the temperatures are degrees centigrade unless otherwise indicated.

EXAMPLE 1

Specimens of Ti(6,4) were heated at 900° C. for two hours in lithium baths containing various concentrations of carbon. The surface of the titanium alloy had been preconditioned by exposure to nitrogen at 500° C. for two hours. Metallography was used to determine the thickness and uniformity of the surface layer. The results given in Table I show that the specimens heated in lithium baths containing from two percent to twenty percent by weight of carbon had carbide coatings of comparable thickness. There was less weight gain and a thinner surface coating formed in the bath containing forty percent carbon. The surface of each of the coated specimens showed very good resistance to scratching when an attempt was made to produce a scratch on the surface using a professional dental probe tool with a sharp point.

TABLE I

Carbide Coatings Formed on Ti(6,4) in Lithium Bath (2 hours at 900° C.)

| % C In Bath | Weight Gain ($mg/cm^2$) | TiC Thickness Range (Microns) |
|---|---|---|
| 2 | 0.52 | 8.4–11.8 |
| 5 | 0.72 | 8.4–12.1 |
| 15 | 0.57 | 6.7–11.8 |
| 20 | 0.65 | 8.5–11.8 |
| 40 | 0.38 | 5.1–7.8 |

EXAMPLE 2

Figure 2:
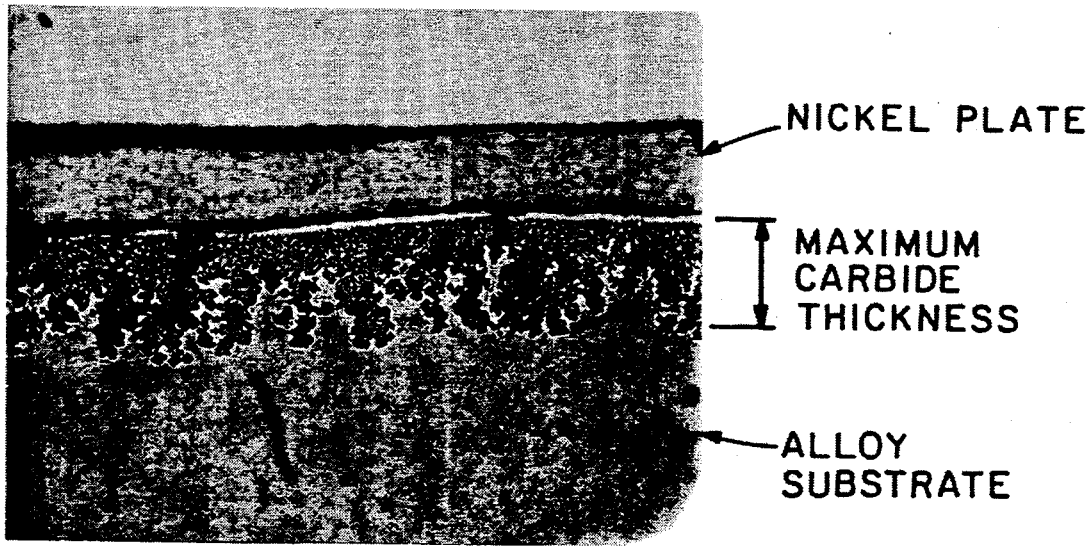
FIG. 2 is a photomicrograph (375×) of a Ti(6,4) substrate which was carburized in accordance with the present invention in a bath containing lithium plus twenty percent carbon for two hours at 950° C. The Ti(6,4) was exposed to nitrogen at 500° C. for two hours before it was carburized.

The general procedure of Example 1 was followed, except that the temperature and length of time of immersion in the bath were varied. In all cases, the lithium bath contained twenty percent carbon. Weight gain and coating thickness of the samples were measured as before. The scratch resistance of the surface was again measured using a professional dental probe tool with a very sharp point. Uncoated titanium alloy can be scratched with only slight hand pressure when using this instrument. The tool can be made to penetrate the carbide coating if the metallographically measured coating thickness is less than about 5 microns. When the coating thickness exceeded about 20 microns, the tool skated across the surface irrespective of the manual pressure exerted. The results given in Table II demonstrate the relationship between the time and temperature used for coating process and the thickness of the coating produced. This data was also used to prepare the curve shown in FIG. 1. A photomicrograph of the sample prepared by heating the alloy in the bath at 950° C. for two hours is shown in FIG. 2.

TABLE II

Carbide Coatings Formed on Ti(6,4) in Li-20% C Bath

| Temperature (°C.) | Time (hrs.) | Weight Gain ($mg/cm^2$) | Coating Thickness (microns) |
|---|---|---|---|
| 800 | 6 | 0.12 | 0.7–1.7 |
| 850 | 2 | 0.02 | 0 |
| 850 | 4 | 0.32 | 1.4–4.1 |
| 850 | 6 | 0.30 | 3.0–5.7 |
| 850 | 12 | 0.22 | 2.4–7.5 |
| 900 | 2 | 0.65 | 8.5–11.8 |

TABLE II-continued

| Carbide Coatings Formed on Ti(6,4) in Li-20% C Bath | | | |
|---|---|---|---|
| Temperature (°C.) | Time (hrs.) | Weight Gain (mg/cm$^2$) | Coating Thickness (microns) |
| 900 | 4 | 1.16 | 15.9–21.3 |
| 900 | 12 | 2.01 | 20.3–42.3 |
| 925 | 6 | 2.55 | 23.7–52.0 |
| 950 | 2 | 1.95 | 20.3–47.4 |
| 950 | 4 | 2.70 | 31.8–54.2 |
| 950 | 4 | 4.53 | 27.1–77.8 |
| 950 | 6 | 7.02 | 30.5–108.0 |

EXAMPLE 3

The general procedure of Example 1 was followed, except that the lithium in the bath was replaced by other metals. The results given in Table III show that the process of this invention is satisfactorily carried out using baths in which the lithium is replaced by calcium, barium or a mixture of calcium and lithium. Because of the high vapor pressure and unusually reactive nature of sodium, the reaction using sodium was limited to 800° C. in the equipment used. Although the pressure of the argon gas was increased to two atmosphere inside the retort, sodium still evaporated and condensed in the cooler zones of the closed system. A thin carbide coating was obtained using this solvent, but the rate of carburization is comparatively slow at this temperature. When calcium and barium were used in the bath, it was necessary to use lower concentrations of carbon in order to obtain a fluid bath. No coating was observed from a magnesium bath under the conditions of the experiment, and some weight loss of the substrate was observed. Scratch resistances of the coatings formed in the calcium and barium baths were very good, and an excellent scratch resistance was observed for the thick coating obtained in the bath containing both calcium and lithium.

TABLE III

| Carbide Coatings Formed on Ti(6,4) in Metal Baths | | | | |
|---|---|---|---|---|
| Solvent | % C | Temperature °C. | Time (hrs.) | Carbide Thickness (avg. microns) |
| Sodium | 20 | 800 | 6 | 1.0 |
| Calcium | 12 | 950 | 4 | 27.8 |
| Barium | 9 | 950 | 4 | 16.1 |
| Magnesium | 20 | 950 | 4 | 0.0 |
| Ca-13% Li | 12 | 1100 | 4 | 250.0 |

EXAMPLE 4

The general procedure of Example 1 was repeated using unalloyed titanium and an alloy of titanium containing fifteen percent Cr, three percent Al, three percent V and three percent Sn as substrates. In both cases, surface carbide formation was obtained using a lithium bath containing twenty percent carbon and a temperature of 900° C.

EXAMPLE 5

The general process of the previous examples was followed except that other metals were used instead of titanium as the substrate. The results given in Table IV show that the process of this invention is useful for forming carbide coatings on the substrates vanadium, niobium, tantalum and molybdenum.

TABLE IV

| Carbide Coatings Formed on Refractory Metals | | | | | |
|---|---|---|---|---|---|
| Refractory Metal | Metal Bath | % C | Temperature (°C.) | Time (hrs.) | Coating Thickness (Microns) |
| V | Li | 20 | 900 | 6 | 3.3–6.0 |
| Nb | Ca | 12 | 1100 | 4 | 3.4–8.1 |
| Ta | Ca + 13% Li | 12 | 1100 | 4 | 4.7 |
| Mo | Ca | 12 | 1100 | 4 | 5.0 |

EXAMPLE 6

Figure 3:
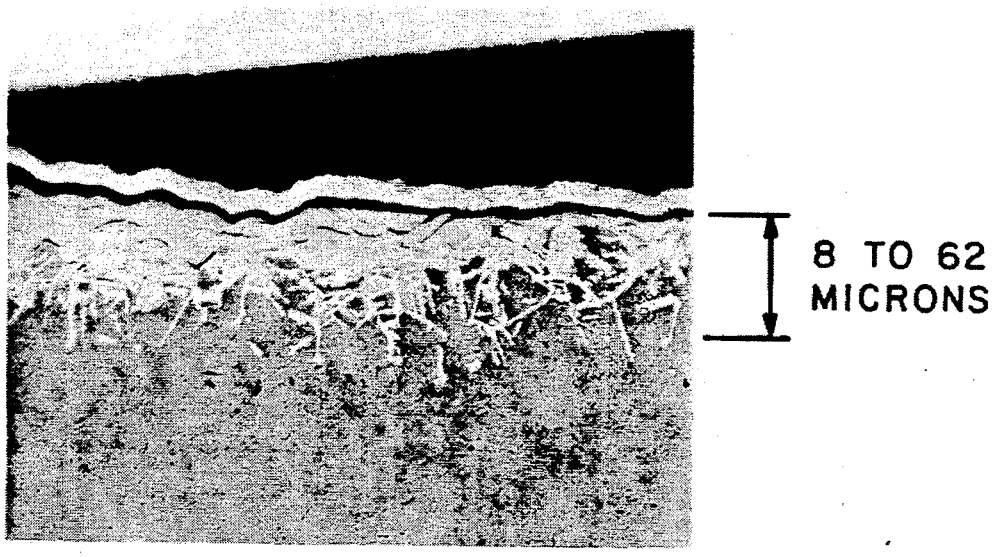
FIG. 3 is a photomicrograph (375×) of a tantalum substrate which was carburized in accordance with the present invention in a bath containing calcium plus thirteen percent lithium and twelve percent carbon for four hours at 1100° C. The tantalum was exposed to nitrogen at 500° C. for two hours before it was carburized.
Figure 4:
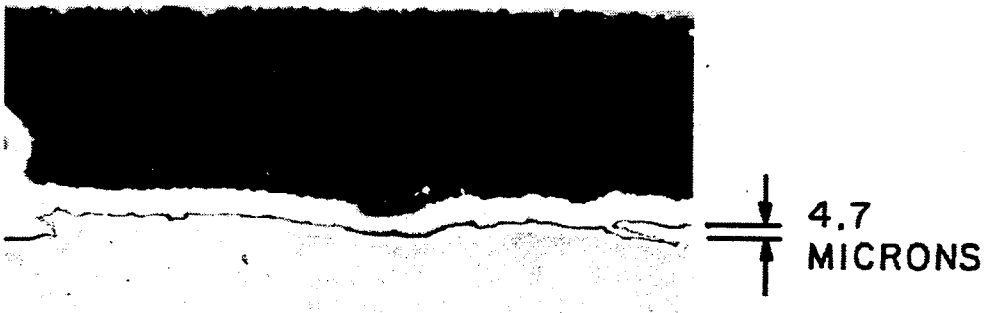
FIG. 4 is a photomicrograph (375×) of a tantalum substrate which was carburized according to the present invention under the same conditions as that used to carburize the specimen shown in FIG. 3; except that the metal was not heated with nitrogen prior to the carburization reaction.

In order to demonstrate the effect of surface pretreatment, a sample of tantalum was exposed to nitrogen gas at 500° C. for two hours. The material was then heated in a bath containing calcium, thirteen percent lithium and twelve percent carbon under the same conditions as used for untreated tantalum in Example 5. The photomicrographs of the tantalum samples are given in FIGS. 3 and 4. The sample which had been exposed to nitrogen prior to coating (FIG. 3) has a deeper and more uniform carbide coating than that on the tantalum which was not pretreated (FIG. 4).

EXAMPLE 7

A carbide coating was formed on a Ti(6,4) substrate by heating in a lithium bath containing twenty percent carbon for two hours at 950° C. The carbide layer was 20–47 microns in depth. This material was then annealed at 950° C. for two hours in a vacuum oven of about $10^{-6}$ torr. Although the photomicrograph of the annealed material showed that some carbon and/or aluminum had diffused from the coating, the coating retained its initial thickness and excellent scratch resistance after the annealing.

EXAMPLE 8

A test was performed to simulate the medical application an implantible human joint devices. In such devices, a polished titanium surface is articulated against ultra high molecular weight polyethylene. For this study, 6.4 mm diameter rods of Ti(6,4) alloy were rotated under pressure against the ultra high molecular weight polyethylene, immersed in Ringer's solution. Some metal test rods were passivated by treatment in forty percent nitric acid at 70° C. for four hours. Other rods contained a carbide coating prepared according to the process of the present invention by heating in a carbon-containing lithium bath at 900° C. for two hours. All rods were tested in continuous rotation with a measured thrust force applied in increments with examination of both articulating surfaces at each increase. Film breakdown pressures were 875 psi (pounds per square inch) for rods with a highly polished surface and 3,000 psi for rods whose surface had been polished and then passivated with nitric acid. In contrast, the titanium rods containing the carbide surface of the present invention did not break down even at a pressure of 11,600 psi.

Thus, it is apparent that there has been provided, in accordance with the invention, a method for forming carbide coating on refractory metals and their alloys that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to include all such alternatives, modifications, and variations as set forth within the spirit and broad scope of the appended claims.

What is claimed is:

1. A method for forming a carbide coating on a metal substrate selected from the group consisting of Group IVA metals, Group VA metals, Group VIA metals and alloys of said metals which comprises:

providing a bath consisting essentially of a molten metal under an inert gas atmosphere wherein the molten metal is selected from the group consisting of alkali metals, alkaline earth metals and mixtures thereof; and then dissolving in the molten metal bath an amount of carbon from about two percent to about twenty percent by weight of the mixture of molten metal and carbon;

placing the metal substrate in the molten metal bath containing dissolved carbon;

maintaining the metal substrate in the molten metal bath until a carbide coating is formed on the metal substrate; and removing the carbide coated metal substrate from the molten metal bath;

wherein the metal substrate is heated in an atmosphere containing nitrogen for a sufficient time to form a visual nitride layer on the surface of the metal substrate before the metal substrate is placed in the molten metal bath.

2. The method of claim 1 wherein the metal substrate is heated in an atmosphere containing nitrogen for about two hours at a temperature of about 500° C. before the metal substrate is placed in the molten metal bath.

* * * * *